United States Patent [19]

Locatelli et al.

[11] 4,295,599

[45] Oct. 20, 1981

[54] FILE BOX

[75] Inventors: John D. Locatelli, 3340 59th Ave. SW., Seattle, Wash. 98116; Gary M. Gunderson, Seattle, Wash.

[73] Assignee: John D. Locatelli, Seattle, Wash.

[21] Appl. No.: 150,343

[22] Filed: May 16, 1980

[51] Int. Cl.[3] ..... B65D 5/22

[52] U.S. Cl. ..... 229/34 R; 312/258; 312/290; 312/183

[58] Field of Search ..... 229/34 R; 312/290, 258, 312/183; 206/44 B, 425; 211/58

[56] References Cited

U.S. PATENT DOCUMENTS

| | | | |
|---|---|---|---|
| 1,826,962 | 10/1931 | Spare | 229/34 R X |
| 1,909,472 | 5/1933 | Keppler | 229/34 R X |
| 2,105,953 | 1/1938 | Ouellette | 229/34 R |
| 2,374,965 | 5/1945 | Weston | 312/290 |
| 2,505,034 | 4/1950 | Fettinger | 229/34 R X |
| 2,663,487 | 12/1953 | Paige | 229/34 R |
| 2,942,768 | 6/1960 | McCall | 229/34 R X |
| 3,373,923 | 3/1968 | Martelli | 229/34 R |
| 3,645,437 | 2/1972 | Giebel et al. | 229/34 R X |
| 3,669,341 | 6/1972 | Hughes | 229/34 R X |
| 4,062,607 | 12/1977 | Locatelli | 312/258 |

*Primary Examiner*—Davis T. Moorhead

*Attorney, Agent, or Firm*—Graybeal & Uhlir

[57] ABSTRACT

An expanding file box includes a flat bottom panel and a pair of hollow side walls extending upwardly from each side of the bottom panel. The side walls have front and rear entrance openings leading into the interior thereof. The file box also includes flat front and rear panels connected to the front and rear edges, respectively, of the bottom panel to each pivot between a closed substantially vertical position and an open, outwardly tilted position. With the front and rear panels in open position, files or cards located within the box can be tilted relative to each other so that substantially the entire front face of the file is visible. The front panel includes a front sliding panel extending rearwardly from each side edge portion of the front panel to slidably extend into the hollow interior of a corresponding side wall to pivot with the front panel to form an extension of the side walls when the front panel is tilted in open position. Likewise, the rear panel includes rear sliding panels extending forwardly from each side edge of the rear panel to slidably extend into the hollow interior of a corresponding side wall to pivot with the rear panel to form a rear extension of the side walls when the rear panel is tilted rearwardly in open position.

2 Claims, 6 Drawing Figures

Fig. 4
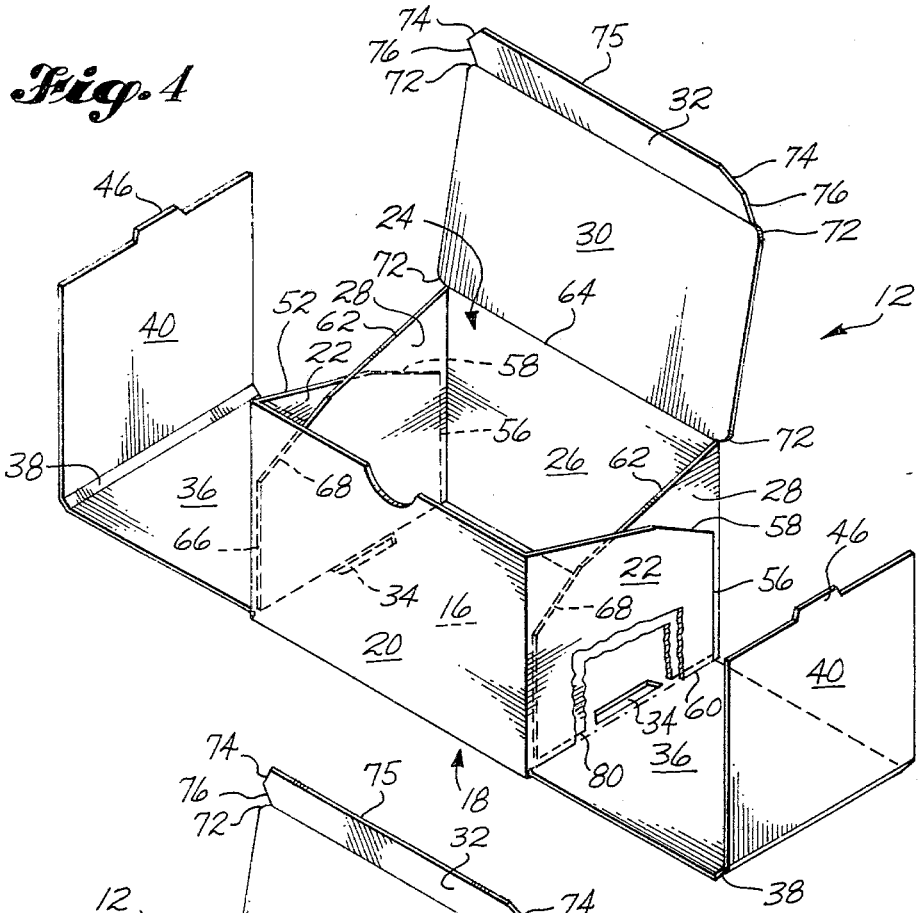
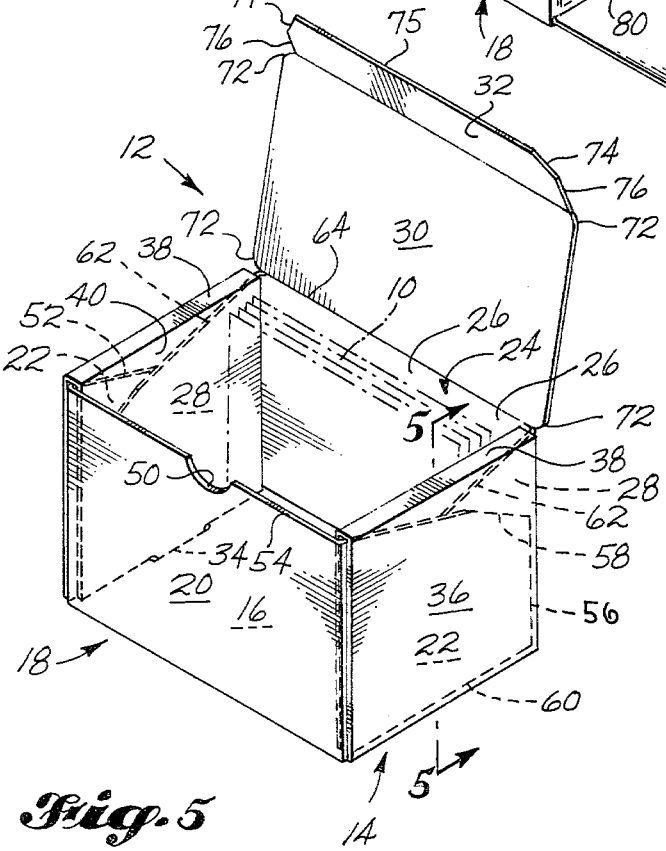
Fig. 5
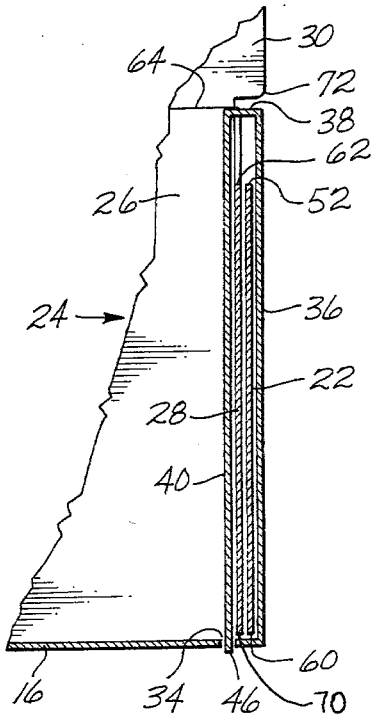
Fig. 6

FILE BOX

BACKGROUND OF THE INVENTION

1. Field of the Invention

This invention relates to a file box, and more particularly, to a file box for cards and the like, having front and rear panels which tilt outwardly to improve access to the materials located therein.

2. Description of the Prior Art

In the past, file boxes typically have been constructed with a rectangularly shaped box having a flat bottom panel and fixed front, rear and side walls all extending upwardly from the bottom panel. A rectangularly shaped top having a shallow rim extending around, and downwardly from, its perimeter is hinged to the upper edge portion of the box rear wall to serve as a lid for the box. Alternatively, the top can be sized slightly larger than the box itself to thereby slide downwardly over the upper rim portion of the box. In either type of top construction, the file folders or file cards, are disposed edgewise within the box.

In situations where a box is used to store materials in file folders, the folders usually have upwardly extending tabs which can be labeled to help the user locate a desired folder. However, if the file box is completely filled, or filled to near capacity, it is very difficult to remove the file or replace it. Also, when the file is removed, the remaining files automatically shift or adjust to occupy the space left by the removed file. Thus, unless the position of the removed file is marked, it is difficult to quickly and conveniently return the file to its original location.

Alternatively, if the file box is used to house file cards, such as recipe cards, index cards are interspaced between the regular cards to separate them into smaller groups and thereby aid in locating a specific card or cards. Still, within each group, the face of the card, or at least the top portion thereof, is typically visually examined to determine the content or subject matter of the card. This visual perusal requires that the box not be so full that the cards cannot be angularly separated from adjacent cards so that each successive card is readily visible to the person using the card file or else the cards must each be at least partially removed from the box to view them. If the box is empty enough to permit adjacent cards to be tilted relative to each other, a significant portion of the capacity of the box is not used, thereby resulting in an inefficient use of filing space. If instead the box is completely, or at least substantially, filled, when a card is removed from the box for use, the location of the card must be marked so that it can be subsequently replaced in its original position.

Therefore, it is a primary object of the present invention to provide a file box which permits the box to be completely filled with cards or files while still permitting adjacent cards or files to be tilted relative to each other for visual inspection of the cards or files without having to remove them from the box. This increased utility of the file box is achieved by constructing the box with front and rear panels which are forwardly and rearwardly tiltable, respectively, to a limited degree.

One known type of card file box having pivoting front and rear panels is disclosed by my prior U.S. Pat. No. 4,062,607 wherein the box is constructed from front and rear panels which are hinged at their lower ends to a pair of end panels which in turn are fixed to a rectangularly shaped bottom panel. Pins extend longitudinally inwardly from the front and rear lower corners of the two end panels to pivotally engage with openings formed in the adjacent lower end edges of the front and rear panels. The bottom panel is trapezoidal in cross-section to thereby define a pair of angularly, downwardly disposed side edges adjacent the front and rear panels. Outward movement of the front and rear panels is limited by abutting contact between the lower, inward surfaces of the front and rear panels against a corresponding adjacent bottom member side edge. When in closed position, the front and rear panels are disposed vertically so that stop means extending upwardly from the top edges of these two panels engage into mating openings provided in the lower surface of a separate, flat, rectangularly shaped top panel. When the top panel is removed, the front and rear panels are then free to pivot outwardly.

A further type of file box is disclosed by U.S. Pat. No. 2,374,965 to Weston, which box includes a base member having shallow side walls and higher end walls each formed in the shape of a truncated triangle. A relatively tall, formed, side member is pivotally mounted on each of the side walls of the base member. Each of the two side members includes inwardly directed, triangularly shaped flanges or wings which overlap the ends walls of the base member. The wings are formed with an arcuate slot for slidably receiving pins extending outwardly from the base member end walls. The two formed side members are pivotably movable between a closed inwardly tilted position wherein the upper edges of the side members contact each other; and an open, outwardly tilted position wherein the pins of the base member end walls stop against the end of the side member wing slots to limit the outward movement of the side members. A drawback of this particular type of construction is that the capacity of the box is severely reduced, as compared to even a standard or conventional storage box as described above, due to the fact that the side panels are angled towards each other to a substantial degree when the box is in closed position thereby reducing the effective width of the box.

SUMMARY OF THE INVENTION

The present invention relates to a novel file box which, in basic form, is characterized by a flat, rectangular shaped bottom panel and hollow side walls extending upwardly from the side edge portions of the bottom panel. Each side wall includes a rectangularly shaped outside panel secured to, and extending upwardly from a corresponding side edge portion of the bottom panel to form an exterior side surface of the file box. Each formed side wall also includes a narrow top edge panel extending horizontally inwardly from the upper edge of each outside panel, and an inside panel extending downwardly from the side of each top edge panel opposite its outside panel to cooperate with corresponding outside and top edge panels to thereby form a hollow side wall with front and rear entrance openings extending substantially the full height of each side wall. A short tab extends downwardly from the lower edge of each side wall inside panel to engage within an elongate, narrow slot formed in the bottom panel centrally along each side edge portion thereof.

My new file box is further characterized by a rectangularly shaped, upright front panel pivotally connected along its bottom edge portion to the front edge portion of the bottom panel to extend upwardly to the top edge of the side walls. A front sliding panel extends transversely rearwardly from each side edge of the front panel to slidably extend through a corresponding side wall front opening and into the hollow interior of the side wall. Each front sliding panel includes a sloped upper edge which is inclined downwardly in the direction away from the front panel, and an upright edge at the end of the sliding panel opposite the front panel. A diagonal corner edge interconnects the upper and end edges of each front sliding panel. The front panel and its two associated sliding panels are pivotally relative to the bottom panel between a closed position wherein the front panel is disposed substantially vertically against the front entrance openings of the two hollow side walls and the front sliding panels are disposed substantially entirely within their corresponding side walls; and an open position wherein the front panel is tilted forwardly and the sliding panels extend outwardly forwardly from their corresponding side walls to actually form a front extension of the side walls. The diagonal edges of the front sliding panels abut against the underside of the side wall top edge panels to limit the extent of forward tilt of the front panel.

The file box also includes a rectangularly shaped rear panel pivotally connected along its bottom edge portion to the rear edge of the bottom panel. A rear sliding panel extends transversely forwardly from each side edge of the rear panel to slidably extend through a corresponding side wall opening and into the hollow interior of the side wall. Each rear sliding panel includes a sloped upper edge portion which is inclined downwardly in the direction away from the rear panel, and an upright edge portion at the end of the sliding panel opposite the rear panel. A corner edge diagonally intersects the top and end edges of each rear sliding panel. The rear panel and its two associated sliding panels are pivotable with respect to the bottom panel between a closed position and an open rearwardly tilted position. When in closed position the rear panel is disposed substantially vertically against the rear entrance opening of the side walls, and the rear sliding panels are disposed substantially entirely within the hollow interior of a corresponding side wall to lie adjacent a corresponding front sliding panel. In contrast, when the rear panel is in tilted, open position, the rear sliding panels extend rearwardly outwardly from the side walls to form a rear extension of the side walls. The diagonal edges of the rear sliding panels abut against the underside of the side wall top edge panels to limit the extend of rearward tilt of the rear panel.

A top panel, which serves as a cover for the file box, is pivotally connected along its rear edge portion to the top edge portion of the rear panel. The top panel can pivot between a first position overlying the side walls to close off the top of the file box, and a second position extending vertically upwardly from the rear panel to permit access to the file box.

A relatively short front flap extends transversely from the top panel to extend downwardly along the inside surface of the front wall when the top panel is in first or closed position. The flap is slightly shorter than the length of the top panel to thereby fit between the inside panels of the side walls. An upwardly open notch is provided in the upper edge portion of the front panel to allow the user to push upwardly and inwardly with his or her finger against the front flap when opening the top panel to gain access to the file box.

According to another aspect of the present invention, all of the panels of the file box, including the panels composing the hollow side walls, are constructed from a unitary sheet of substantially rigid material, such as cardboard, which is pre-cut in a contour corresponding to the composite shape of all of the panels when disposed in flat, unfolded position. Beginning with a rectangularly shaped bottom panel, the panels composing the side walls, the outside panel, the top edge panel and the inside panel, extend sequentially outwardly from each end of the bottom panel. The front panel extends forwardly outwardly from the front edge of the bottom panel and then the front sliding panels extend transversely outwardly from each side edge of the front panel to lie adjacent a corresponding side wall outside panel. The rear panel, the top panel, and the front flap panel extend sequentially rearwardly outwardly from the bottom panel. Analogously to the front sliding panels, the rear sliding panels extend transversely outwardly from each side edge of the rear panel to lie adjacent a corresponding side wall outside panel.

The file box is assembled by first folding the front and rear panels upwardly and then turning their corresponding sliding panels transversely to the plane of the front and rear panels so that they lie adjacent each other across the end of the bottom panel. Thereafter, the side walls are formed by first folding the outside panels upwardly, next folding the top edge panels transversely to the outside panels to horizontally overlie corresponding front and rear sliding panels and then folding the inside panels downwardly and inserting their tabs into corresponding bottom panel slots so that each inside panel is fixed parallel its corresponding outside panel. To close the box, the top panel is folded transversely to the rear panel to horizontally overlie the side walls and then the front flap is turned transversely to the panel to lie downwardly adjacent the inside surface of the front panel.

The top can be opened by simply pressing against the flap panel and lifting upwardly. Thereafter, the box can be shifted to open position by simply pushing outwardly on the front and rear panels to tilt them forwardly and rearwardly, respectively, to thereby provide ready access to the file folders or file cards even when the file box is completely filled with files or cards. When the file box is in open position, the cards or file folders rest against either the inclined front and rear panels, or both, making it unnecessary to manually hold the files or cards separated apart when viewing a single file or card.

It is a primary object of the present invention to provide a file box constructed with limitedly tiltable front and rear panels to thereby provide ready access to the file cards or folders stored within the box even when the box is completely filled with cards or folders.

Another object of the present invention is to provide a file box which allows substantially the entire faces of the folders or cards stored within the box to be conveniently viewed without removing the folders or cards from the box even if the box is completely filled.

A further object of the invention is to provide a file box which even when completely filled with cards or folders enables the cards or folders to be separated into a forwardly tilted group and a rearwardly tilted group so that an individual file or card can be conveniently removed and inserted within a sequence group of folders or cards.

An additional object of the present invention is to provide a file box which can be fabricated at very low cost from commonly available stock material.

Yet another object of the present invention is to provide a file box constructed from a unitary piece of semi-rigid material, contoured to correspond to the composite shape of all of the panels of the file box laid out in a flat plane, with the box assembled by folding the various panels relative to each other.

Still a further object of the present invention is to provide a file box which can be unfolded into a flat sheet when not in use for extremely compact storage and transportation.

Yet another object of the present invention is to provide a file box which is extremely lightweight and easily portable, but durable enough to withstand rough handling and extensive use.

BRIEF DESCRIPTION OF THE DRAWINGS

FIG. 4 is an isometric view of the typical file box of the present invention shown in FIG. 3, illustrating the box partially assembled with the front and rear formed panel sections in upright, folded position and the side walls partially folded;

FIG. 5 is a perspective view of the typical file box of the present invention shown in FIG. 4, illustrated in assembled form with the front and rear formed sections in closed, folded position, and with the top of the box open; and FIG. 6 is a partial cross-sectional view of an end wall of the typical file box in FIG. 5 with the front and rear sliding panels located therein, as taken substantially along lines 6—6 of FIG. 5.

DETAILED DESCRIPTION OF A PREFERRED EMBODIMENT

Figure 1:
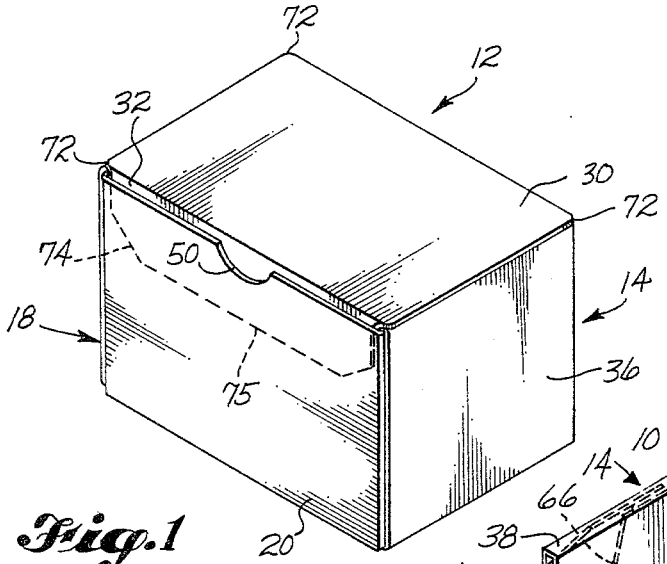
FIG. 1 is a perspective view of a typical file box constructed according to the present invention with the box in closed configuration.
Figure 2:
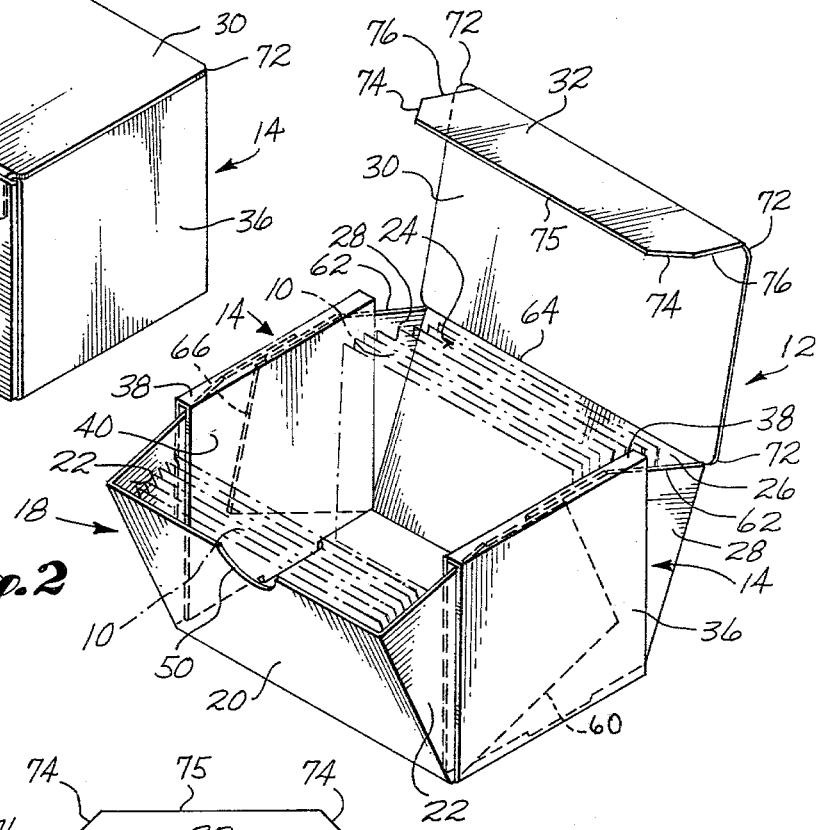
FIG. 2 is a perspective view of the typical file box of the present invention shown in FIG. 1, with the top open and the front and rear panels tilted outwardly.

Referring initially to FIGS. 1 and 2, a set of file cards 10 or the like are stored within a file box 12 constructed according to the best mode of the present invention currently known to applicant. Referring additionally to FIG. 5, file box 12 includes a pair of hollow side walls 14 which extend upwardly from a flat bottom panel 16. The box 12 also includes a formed front section 18 composed of a front panel 20 pivotally connected to bottom panel 16, and a pair of front sliding panels 22 extending within the hollow interior of side walls 14. A rear formed section 24 includes a rear panel 26 pivotally connected to the edge portion of bottom panel 16 opposite front panel 20, and a pair of rear sliding panels 28 extending transversely forwardly from the rear panel and into the hollow interior of sidewalls 14. Front and rear formed sections 18 and section 24 are shiftable between a closed, vertical position, shown in FIGS. 1 and 5, and an open, outwardly tilted position shown in FIG. 2.

File box 12 further includes a top or cover panel 30 which is pivotally attached to the upper edge portion of rear panel 26 to close off the top of file box 12 when formed front and rear sections 18 and 24, respectively, are in closed position, FIG. 1. A front flap panel 32 extends transversely downwardly from the front edge portion of top panel 30 to frictionally bear against the inside surface of front panel 20 to keep top panel 30 closed when formed front section 18 is in its closed position as shown in FIG. 1.

As most clearly illustrated in FIGS. 2–5, bottom panel 16 is flat and rectangular in shape. A narrow, elongate slot 34 extends centrally along each marginal side portion of bottom panel 16. Additionally referring to FIGS. 1 and 6, formed hollow sidewalls 14 extend upwardly in spaced parallel relationship to each other from each side of bottom panel 16. Each side wall 14 is composed of a rectangularly shaped outside panel 36 having its lower edge portion attached to an adjacent side edge portion of bottom panel 16. The width of outside panel 36 is the same as the width of bottom panel 16. Each side wall 14 also includes a relatively narrow top edge panel 38 extending horizontally inwardly, from the top edge of outside panel 36 to intersect with the upper edge portion of sidewall inside panel 40. Inside panel 40 is constructed in a rectangular shape and size corresponding to the shape and size of the outside panel 36, and further is disposed vertically in spaced parallel relationship to outside panel 36 to thereby cooperate with the outside panel and the top edge panel to form a hollow wall construction having front and rear openings extending the full height of the sidewalls 14. A short tab 46 extends downwardly from the lower edge of each side wall inside panel 40 to snugly engage within a corresponding bottom panel slot 34 to thereby transversely restrain the bottom edge portion of panel 40.

Formed front section 18, as best shown in FIGS. 1, 2 and 5, includes a flat, rectangularly shaped front panel 20 having a length corresponding to the length of bottom panel 16 and a height corresponding to the height of side wall outside and inside panels 36 and 40, respectively, to thereby close off the front of box 12 when front section 18 is in the closed position illustrated in FIG. 1. The bottom edge portion of front panel 20 is hingedly or otherwise pivotally connected to the front edge portion of bottom panel 16 to permit the front panel to pivot from a closed, vertical position bearing against the front edge of side walls 14, as shown in FIGS. 1 and 5, to an open, forwardly tilted position, shown in FIG. 2. An upwardly open, semicircularly shaped slot 50 is centrally located along the upper marginal edge portion of front panel 20. Ideally, slot 50 is large enough to receive a user's finger or thumb during the process of opening top panel 30. It is to be understood that slot 50 can be formed in other shapes such as square or rectangular.

In addition to front panel 20, front formed section 18 also includes a pair of planar front sliding panels 22 which extend transversely rearwardly from each side edge portion of the front panel through a corresponding sidewall front opening and into the hollow interior of the side wall 14. As perhaps best illustrated in FIGS. 4 and 5, when formed front sections 18 is nominally disposed in closed position, the top edge 52 of each of the front sliding panels 22 slopes downwardly from the top edge 54 of front panel 20 in the direction away from the front panel toward end edge 56 located oppositely to the front panel. A corner edge 58 diagonally intersects the top edge 52 and end edge 56 of each front sliding panel 22. When front section 18 is in the closed position, shown in FIGS. 1 and 5, front sliding panels 22 are both substantially entirely disposed within the hollow interior of side walls 14 so that the bottom edges 60 of the sliding panels horizontally overlie bottom panel 16 while the end edges 54 of the sliding panels are disposed in substantially vertical orientation. However, as front section 18 is pivoted to the open position illustrated in FIG. 2 so that front panel 20 is tilted forwardly, front sliding panels 22 slide in a rocking motion relative to side wall 14 until corner edges 58 bear against the underside of side wall top panel 30 to thereby act as a stop for limiting the forward tilt of front panel 20. When thusly held in open position, front sliding panels 22 extend forwardly, outwardly from the front opening of side walls 14 to thereby serve as a forward extension of the side walls and thus laterally constrain the file cards 10 which are tilted forwardly against front panel 20.

The construction and function of rear formed section 24, as shown in FIGS. 1, 2, and 5, closely corresponds to that of front formed section 18. Accordingly, rear section 24 includes a planar, rectangularly shaped rear panel 26 having a width corresponding to the width of bottom panel 16 and a height corresponding to the height of side wall outside and inside panels 36 and 40, respectively. The bottom edge portion of rear panel 26 is hingedly, or otherwise pivotally attached to the rear edge portion of bottom panel 16 to thereby enable the rear panel to shift between a closed, vertical position bearing against the rear edge of side wall inside panel 40, as shown best in FIG. 5, and an open position, tilting outwardly and rearwardly from side walls 14, as shown in FIG. 4.

In addition to rear panel 26, rear formed section 24 also includes a pair of rear sliding panels 28, each extending transversely forwardly from opposite side edges of the rear panel to extend through a corresponding side wall rear opening and into the hollow interior of the side wall to lie sandwiched between the inside surface of a sidewall inside panel 40 and the adjacent surface of a front sliding panel 22, FIG. 6. Each rear sliding panel 28 includes a top edge 62 which slopes downwardly and forwardly away from the top edge 64 of rear panel 26 toward an end edge 66 which is disposed vertically and adjacent front panel 20 when rear formed section 24 is disposed in closed position, as shown mostly clearly in FIG. 4. Each rear sliding panel 28 also includes a corner edge 68 which diagonally intersects a top edge 62 and an end edge 66. As best shown in FIG. 5, when formed rear section 24 is in closed position, substantially the entire length of each rear sliding panel 28 is disposed within the hollow interior of a corresponding side wall 14 so that the bottom edge 70 of the sliding panel horizontally overlies a corresponding marginal side portion of bottom panel 16. Alternatively, when rear formed section 24 is in open position with rear panel 26 tilted outwardly, as shown in FIG. 2, corner 68 abuts against the underside of its corresponding side wall top edge panel 38 to thereby limit the extent to which the rear panel can tilt outwardly. Also, with rear panel 26 thusly tilted, rear sliding panels 28 extend rearwardly from their corresponding side walls 14 to serve as an extension of the side walls to thereby restrain the file cards 10 resting against the rear panel.

It can be appreciated that in addition to serving as an extension of side wall 14, rear sliding panels 28 cooperate with front sliding panels 22 to maintain side walls 14 in vertical orientation. As illustrated best in FIG. 6, front and rear sliding panels 22 and 28, respectively, fit snugly within their corresponding side walls 14 to limit the extent of which side wall 14 can pivot relative to bottom panel 16 before bearing against the sliding panels, at which point the wall is prevented from any further movement since front sliding panels 22 are securely attached to front panel 20 and rear sliding panel 28 are securely attached to rear panel 26.

The top of file box 10 is closed off by a rectangularly shaped, flat cover panel 30 which is of a width corresponding to the width of side wall 14 and a length slightly greater than the length of rear panel 26 to thereby overlap side walls 14 and lie flush with the outside surface of side wall outside panel 36. The rear edge portion of cover panel 30 is hinged, or otherwise pivotally connected, to the upper edge portion of rear panel 26 to thereby pivot between a closed position, overlapping side walls 14 as shown in FIG. 1, and an open position extending upwardly from rear panel 26, as shown in FIGS. 2, 4 and 5. For reasons of safety and ease of manufacture, the corners 72 of cover panel 30 are preferably rounded rather than being left sharp.

File box 12 also includes a front flap panel 32 extending along the front edge of cover panel 30 in a direction transversely outwardly from the underside of the cover panel so that when the cover panel is in the closed position illustrated in FIG. 1, flap panel 32 bears against the inside surface of the upper marginal edge portion of front panel 20 to effect a seal between the cover panel and the front panel and prevent the cover panel from accidentally opening. Ideally, flap panel 32 is slightly shorter than cover panel 30 to enable its side edges 75 to frictionally bear against the inside panels 40 of side walls 14 to keep the cover panel closed. Also, preferably flap panel 32 is wide enough to extend below slot 50 when cover panel 30 is closed, as shown in FIG. 1. Moreover, in preferred form, the corners 74 of flap panel 32 are beveled to diagonally intersect the leading and side edges 75 and 76, respectively, of the flap panel to thus serve as guide edges to center the flap panel when closing cover panel 30. Without beveled corners 74, it would be more difficult to position front flap panel 32 between side walls 14, especially since the side edges 76 of the flap panel frictionally bear against side wall inside panels 40, as discussed above.

Figure 3:
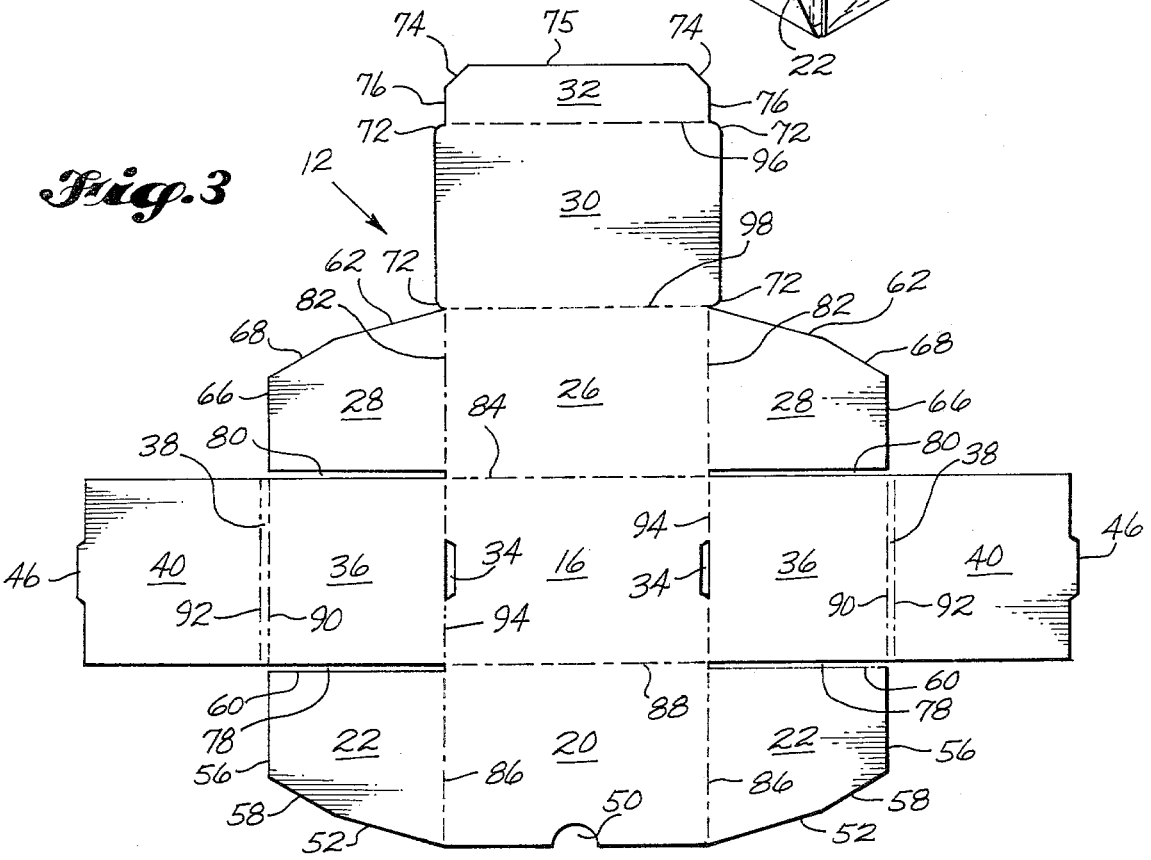
FIG. 3 is a top view of the typical file box of the present invention depicted in FIG. 1 with the panels of the box laid out flat specifically illustrating the integral construction of the box.

Although file box 12 could be constructed from individual panels joined or hinged together, preferably the entire box is made from a single, planar sheet of semi-rigid sheet material, such as cardboard or plastic, contoured in the composite shape of the panels when they are all layed out flat in the manner shown in FIG. 3. Box 12 is assembled by folding the panels in the manner described below. When box 12 is in its flat, unfolded configuration shown in FIG. 3, the outside panel 36, edge panel 38 and inside panel 40 of each side wall 14 extend sequentially outwardly from a corresponding side edge of centrally located bottom panel 16. Front panel 20 extends forwardly from bottom panel 16, and front sliding panels 22 are disposed laterally outwardly from each side edge of the front panel to lie a short distance forwardly adjacent a corresponding side wall outside panel 36, separated therefrom by a narrow gap 78. Rear panel 26, cover panel 30 and flap panel 32 are arranged sequentially rearwardly from the rear edge portion of bottom panel 16, and thus are disposed in a direction opposite from front panel 20. Rear sliding panels 28 extend laterally outwardly from each side edge portion of rear panel 26 to lie closely, rearwardly adjacent side wall outside panels 36, and are separated therefrom by a narrow gap 80. It can be appreciated that the singular, nominally flat sheet from which file box 12 is preferably formed can be very compactly transported or stored, especially in comparison to the assembled form of the box.

The procedure for assembling file box 12 is illustrated in FIGS. 3 through 5, the first step of which is to fold rear sliding panels 28 upwardly relative to flat rear panel 26 along bend lines 82. Next rear panel 26 is turned upwardly relative to bottom panel 16 along bend line 84 extending therebetween to thereby swing rear sliding panels 28 forwardly to vertically overlie the marginal end portions of bottom panel 16 in a manner shown in FIG. 4. The two front sliding panels 22 are then rotated upwardly relative to flat front panel 20 along bend lines 86. If box 12 is made from cardboard, bend lines 86, and all of the other bend lines utilized to assemble box 12 can be preformed by, for example, scoring the underside of the flat sheet shown in FIG. 3 along the intersections of the individual panels. If instead box 12 is made from panels of plastic, the bend lines separating adjacent panels could be formed somewhat thinner and thus more flexible than the panels themselves.

The next step in assembling box 12 is to lift front panel 20 upwardly relative to flat bottom panel 16 about fold line 88 to thereby swing front sliding panels 20 rearwardly to lie outwardly adjacent rear sliding panels 28, in the manner shown in FIG. 4. Thereafter, each sidewall inside panel 40 is rotated upwardly relative to flat inside panel 36 by folding edge panel 38 to a diagonal orientation relative to outside panel 36 along bed line 90 and then folding inside panel 40 relative to diagonally disposed edge panel 38 along bend line 92 to the position shown in FIG. 4. Next, each outside panel 36 is turned upwardly relative to bottom panel 16 along bend lines 94 to outwardly overlie front sliding panels 22. The assembly of each side wall 14 is completed by simultaneously bending upper edge panel 38 to a horizontal orientation overlying front and rear sliding panels 22 and 28, and then folding inside panel 40 downwardly into the vertical orientation shown in FIGS. 2 and 5 to thereby constrain the sliding panels between outside panel 36 and inside panel 40. Finally, tabs 46 are inserted into slots 34 to securely fix the lower edge portion of each inside panel 40 relative to bottom panel 16 and outside panel 36. It will be appreciated that inside panel 40 can be fixed to bottom panel 16 in other ways, such as by utilizing a separate angle shaped joinder member, not shown.

Flap panel 32 is next turned transversely to cover panel 30 along bend line 96 and then cover panel 30 itself is folded relative to rear panel 26 along bend line 98 into a horizontal position to close off the top of box 12. Rather than waiting to fold flat panel 32 and cover panel 30 until the end of the assembly procedure, they can instead be folded before rear panel 26 is folded upwardly relative to flat bottom panel 16. Moreover, the steps of the above-described assembly procedure can be carried out in sequences other than the one described above and still result in the completed box 12 shown in FIGS. 1, 2, 4 and 5.

Once file box 12 has been assembled, it can be filled with cards 10 or file folders, not shown. During the initial filling process, when only a few cards 10 are involved, the cards can be selectively separated into forwardly and rearwardly tilting groups even though the box is in the closed or contracted position shown in FIG. 5. This permits the cards or files to be conveniently placed in their correct position since the face of each card is visible. However, as the number of cards 10 in box 12 increases, the cards eventually cannot be tilted far enough so that they remain divided into a forward and rearward group. At this point, box 12 can be conveniently expanded by pivoting formed front section 18 forwardly until corner edges 58 of its sliding panels 22 abut against the underside of top edge 38, and also by pivoting rear formed section 28 rearwardly until the corner of edges 68 of its sliding panels 28 abut against the underside of side wall top edge panel 38.

It will be appreciated that sloping top edges 52 and 62 of panels 22 and 28, respectively, in the manner described above and illustrated in FIGS. 4 and 5, ensures that there is no interference between the panels and the top edge panel 38 of side walls 14 as the panels slide outwardly and swing upwardly when front panel 20 and rear panel 26 are tilted from their closed position shown in FIG. 5 to their open position shown in FIG. 2. Rather than sloping panel top edges 52 and 62, the height of sliding panels 22 and 28 can be reduced to eliminate any possible interference with the underside of top edge panels 38 as the panels slide outwardly during the expansion of box 12.

In its open or expanded form, box 12 permits cards 10 to be selectively divided into one group which leans against front panel 20 and a second group which leans against rear panel 26 so that virtually the entire face of each card is selectively viewable even if box 12 is completely filled. By visually scanning the face of the cards the user can conveniently read the contents of the cards without removing them from the box, which in addition permits the user to selectively insert a new card within a sequenced group of file cards. Also, the user can remove a particular card from the box and then later conveniently replace it in its proper location since the cards will remain tilted when box 12 is in open position.

It will be appreciated that constructing box 12 in the manner described above, from a single piece of semi-rigid material folded to form the shape of the box, all of the exterior surfaces of the box panel are initally disposed on the underside of the flat material piece shown in FIG. 3. Thus, by providing the underside of the sheet with a decorative outer surface, the outside surface of box 12 can be given a decorative appearance in a desired color or colors. Moreover, constructing box 12 with multiple panel side walls 14 results in a very strong, rigid construction which enables a number of filled boxes to be safely stacked on top of each other without fear that they will collapse or otherwise fail.

If file box 12 is used to house materials in standard or legal length file folders, not shown, side walls 14 and sliding panels 22 and 28 can be provided with openings, not shown, large enough to receive the user's hand so that the box can be conveniently lifted and carried. Also, if files are stored in the box, cover panel 30 and front flat panel 32 can be replaced with a separate top, not shown, having a marginal rim for engaging over the upper edge portion of box 12.

The present invention may be embodied in other specific forms or embodiments without departing from the spirit or essential characteristics thereof. The particular embodiments of the file box, described above, are therefore to be considered in all respects as illustrative and not restrictive. The scope of the present invention is as set forth in the appended claims rather than being limited to the typical examples of the file box set forth in the foregoing description.

We claim:

1. In a file box having a flat, rectangular bottom panel; a pair of hollow side walls extending upwardly from each side edge portion of the bottom panel, the side walls having front and rear entrance openings; an upright front panel pivotally connected along its bottom edge portion to a front edge portion of the bottom panel to enable the front panel to pivot between a closed, substantially vertical position and an open, forward tilted position; an upright rear panel pivotally connected along its bottom edge portion to a rear edge portion of the bottom panel to enable the rear panel to pivot between a closed, substantially vertical position and an open, rearwardly tilted position; and the improvement comprising:

unitary, substantially rigid and flat front sliding panels extending rearwardly from each side edge portion of the front panel to slidably extend through a corresponding side wall front opening a substantial distance into the hollow interior of the side wall;

unitary, substantially rigid and flat rear sliding panels extending forwardly from each side edge portion of the rear panel to slidably extend through a corresponding side wall rear opening a substantial distance into the hollow interior of the side wall to overlap said front sliding panels;

wherein said front and rear sliding panels slide relative to each other within the hollow side walls and said front and rear sliding panels pivot with their corresponding front and rear panels between a closed position wherein said front and rear sliding panels are disposed in maximum overlapping relationship and substantially entirely within a corresponding side wall, and an open position wherein said sliding panels are disposed in substantially overlapping relationship and extend outwardly from the side walls to form, respectively, front and rear extensions of the side walls; and a unitary, substantially rigid, flat top panel having front, rear and side edge portions, said top panel being pivotally connected along its rear edge portion to the top portion of the rear panel to pivot between a first, closed position closely overlying the side walls to substantially close off the top of the file box and second, open position extending upwardly from the rear panel to provide unhindered access to the file box.

2. The improvement according to claim 1, further comprising a generally rectangularly shaped, narrow flap panel integrally formed with said top panel to extend transversely downwardly to lie adjacent the inside surface of the front panel when said top panel is in closed position, said flap panel including:

an upper edge portion pivotally connected to the front edge portion of the top panel along a fold line extending therebetween;

a leading edge portion disposed in spaced parallel relationship to the upper edge portion;

relatively short side edge portions disposed inwardly from the side edge portions of the top panel and extending transversely to the upper edge portion of said flap panel; and beveled corner interconnecting the side edge portions with the leading edge portions of said flap panel to thereby form a lead-in for said flap panel to guide said flap panel into position between the side walls of the file box when positioning the top panel in closed position.

* * * * *